US008381354B2

(12) United States Patent
Haab et al.

(10) Patent No.: US 8,381,354 B2
(45) Date of Patent: Feb. 26, 2013

(54) CARRIAGE FOR A SEPARATION ELEMENT, SEPARATION ELEMENT AND DEVICE

(75) Inventors: Gregor Haab, Allenwinden (CH); Cornel Fuglistaller, Jonen (CH); Peter Ettmuller, Jonen (CH)

(73) Assignee: Hawa AG, Mettmenstetten (CH)

( * ) Notice: Subject to any disclaimer, the term of this patent is extended or adjusted under 35 U.S.C. 154(b) by 420 days.

(21) Appl. No.: 12/699,705

(22) Filed: Feb. 3, 2010

(65) Prior Publication Data

US 2010/0205772 A1 Aug. 19, 2010

(30) Foreign Application Priority Data

Feb. 15, 2009 (EP) ..... 09152881

(51) Int. Cl.
*E05D 15/00* (2006.01)

(52) U.S. Cl. ..... 16/91; 16/87 R; 16/105; 16/87 B; 49/409; 160/196.1

(58) Field of Classification Search ..... 16/91, 87 R, 16/97, 101, 105, 106, 87 B; 49/409, 452; 160/196.1
See application file for complete search history.

(56) References Cited

U.S. PATENT DOCUMENTS

| | | | | |
|---|---|---|---|---|
| 3,925,933 | A * | 12/1975 | Reuter | 49/409 |
| 3,956,854 | A | 5/1976 | Yamamoto | |
| 6,052,867 | A * | 4/2000 | Haab et al. | 16/87.6 R |
| 6,321,413 | B1 * | 11/2001 | Zingg | 16/105 |
| 6,418,588 | B1 | 7/2002 | Haab et al. | |
| 6,438,795 | B1 * | 8/2002 | Haab et al. | 16/85 |
| 6,647,590 | B2 * | 11/2003 | Haab et al. | 16/90 |
| 7,578,096 | B2 * | 8/2009 | Haab et al. | 49/409 |
| 7,849,560 | B2 * | 12/2010 | Kelley | 16/105 |
| 7,891,052 | B2 * | 2/2011 | Haab et al. | 16/98 |
| 2010/0269291 | A1 * | 10/2010 | Haab et al. | 16/91 |

FOREIGN PATENT DOCUMENTS

| | | | |
|---|---|---|---|
| DE | 9011081.1 | U1 | 11/1990 |
| EP | 0 502 285 | A1 | 9/1992 |
| EP | 733766 | A2 * | 9/1996 |
| EP | 1120522 | A2 * | 8/2001 |
| EP | 1 916 372 | A2 | 4/2003 |
| EP | 1 460 225 | A1 | 9/2004 |
| JP | 10331513 | A * | 12/1998 |
| WO | WO 00/65186 | A1 | 11/2000 |

OTHER PUBLICATIONS

Jul. 28, 2009 Search Report issued in European Patent Application No. 09152881.0 (with translation).
Sliding Fittings, Product Catalogue of HAWA AG, 2000, pp. 20-21.

* cited by examiner

*Primary Examiner* — William L. Miller
(74) *Attorney, Agent, or Firm* — Oliff & Berridge, PLC

(57) ABSTRACT

The carriage provided to hold a displaceable separation element comprises a carriage body provided with at least two running wheels, which carriage body is connected to a carrier profile, which serves to carry the separation element. According to the invention the threaded shank of an adjusting screw is rotationally held in the carriage body, which adjusting screw comprises below the screw head a flange ring, which supports a flange element provided in the carrier profile, which flange element comprises an opening, through which the screw head is guided. By rotating the adjusting screw the carrier profile can thus be optionally adjusted in height. In a preferred embodiment a tool channel is provided in the carrier profile, into which tool channel a conventional tool can be introduced.

14 Claims, 10 Drawing Sheets

CARRIAGE FOR A SEPARATION ELEMENT, SEPARATION ELEMENT AND DEVICE

BACKGROUND

The invention relates to a carriage for a displaceable separation element, a separation element held by at least one such carriage and a device with at least one such separation element.

In order to separate or form areas or to close off room, furniture or window openings, walls, sliding elements, doors or blinds provided with a wooden or glass panel (hereinafter referred to as separation elements) are often used, which are fixed to carriages displaceable along a rail.

A device for displaceable separation elements is known from [1], EP 1916372 A1, by means of which a panel, in particular a glass panel, is fixed in a mounting profile of a frame element and can be adjusted in height.

Document [2], Product Catalogue of HAWA AG, Sliding Fittings 2000, discloses a fitting for sliding wardrobe doors that are held so as to be displaceable to the fore of the front of a wardrobe. Each of the sliding wardrobe doors is held on the upper side by at least one first L-shaped mounting profile, which is connected to a carriage, which rolls on a running rail arranged on the upper side of the wardrobe. In order that the sliding door remains held in vertical position it is also held on the lower side by a second L-shaped mounting profile, which holds a guide device, which engages in a guide rail arranged on the lower side of the wardrobe. The first limb of the L-shaped mounting profiles is thus connected to the sliding wardrobe door and the second limb to the carriage/the guide device.

SUMMARY

The carriage and the guide device are arranged in this application above/below the wardrobe, whereby various problems can result. It is often necessary for the height of the separation element to be adjusted at the time of installation or at a later point in time. For this purpose elements that are displaceable in height are provided for example on the fitting and can be adjusted by the installer. This results in corresponding resources being required during the production of the fitting and difficult manipulations during the adjustment. For example the separation element must be released from the rails, after which each fitting must be newly incorporated. Subsequently the separation element is to be hung in the rails again and it is to be checked whether the required height adjustment has been achieved.

It is further to be taken into consideration that the carriage cooperates with a running rail and that the guide device/at least one running wheel provided thereon cooperates with a guide rail. A change to the fitting on the upper side of the separation element can necessitate a change to the fitting on the lower side of the separation element.

It is thereby to be taken into consideration that the simultaneous engagement of the carriage and the guide device into the running rail or the guide rail simultaneously ensures that the separation element cannot become independently released from the rails. In the adjustment of the sliding fittings it is therefore to be ensured that the decoupling prevention mechanism is not raised or blocked.

On account of the arrangement of the carriage above and the guide device below the wardrobe there are also only very small assembly spaces, in which the carriage, the running rail, the guide device and the guide rail are received. It is thereby to be taken into consideration that the assembly space is selected to be sufficiently large in order that not only the device parts can be received therein but also the necessary manipulations can be carried out. Through the choice of a larger assembly area on the other hand the space available for the wardrobe is reduced.

In order to deal with this problem the running rail is mounted in practice from time to time on the wardrobe before the latter is fitted into the installation location. However, this brings with it a particular disadvantage if a plurality of wardrobe elements are provided, which are to be equipped with individual parts of the running rail or guide rail. After the assembly of a multi-part wardrobe and the multi-part running rail there are normally discrepancies at the abutment points of the parts of the running rail joined together. The end elements of the running rail parts are therefore mostly connected to each other using coupling elements in order that misalignments at the abutment points are reduced. Even in case of these additional resources being used, misalignments cannot normally be completely avoided at the abutment points, meaning that the resulting running properties of the carriages are not optimal and their operating lifetime is reduced.

The space problem described is further intensified by the use of buffer devices, which are to be connected to the running rail and which normally take up a relatively large amount of space.

A further disadvantage is that the guide devices preassembled on the lower side of the separation elements, in case of careless mounting of the separation elements, in particular in case a separation element tilts to the side, are exposed to greater forces and damaged.

It is thus an object of the present invention to eliminate the above-described disadvantages of the known devices.

In particular a carriage for a displaceable separation element, a separation element held by at least one such carriage and a device with at least one such separation element are to be created that are not encumbered with the disadvantages described.

The carriage and the separation element are to allow necessary adjustments to be carried out precisely and with minimal resources. In addition the carriage is to have a minimal space requirement. The device with the at least one separation element is to be designed in such a way that only limited assembly space is required. Insofar as a plurality of wardrobe elements is used, interference-causing abutment points on the running rail are to be avoided.

This object is achieved with a carriage, a separation element provided with at least one such carriage and a device that have the features indicated in claims 1, 10 and 12. Advantageous embodiments of the invention are indicated in further claims.

The carriage provided to hold a displaceable separation element comprises a carriage body provided with at least two running wheels, which carriage body is connected to a carrier profile serving to carry the separation element.

According to the invention the threaded shank of an adjusting screw is rotationally held in the carriage body, said adjusting screw comprising below the screw head a flange ring, which supports a flange element provided in the carrier profile, which flange element comprises an opening, through which the screw head is passed.

By rotating the adjusting screw, the head of which is detected by means of a tool, the carrier profile can thus be optionally adjusted in height. The separation element can thus be horizontally orientated.

In a preferred embodiment at least one tool channel is provided in the carrier profile, which preferably comprises a U-shaped profile with two side parts and a middle part. A conventional tool, e.g. a Phillips screwdriver, can be introduced into said tool channel and used to rotate the head of the adjusting screw.

In this connection a coupling chamber is provided in the carrier profile, preferably in the middle part of the U-shaped profile, within which coupling chamber the screw head is arranged and connected to a toothed disk, with which the tool is to cooperate. In order that the tool can be introduced into the coupling chamber and coupled with the toothed disk, the tool channel is provided, which preferably extends parallel to the longitudinal axis of the middle part from one end as far as the coupling chamber or as far as the other end of the carrier profile. In the latter embodiment the tool can thus be introduced from both sides through the carrier profile into the coupling chamber in order to rotate the adjusting screw. In principle the tool channel can be orientated as desired. The orientation along the longitudinal axis of the middle part and thus parallel to the running rail has on the other hand the advantage that the tool can be introduced along the running rail on the front side into the carrier profile. The separation element can thus be adjusted without problems after its installation without the panel having to be removed or the separation element having to be released from the running rail.

It is particularly advantageous that a conventional tool, namely a Phillips screwdriver, can be used for the adjustment. The axes of the Phillips screwdriver and of the tool channel on the one hand and the axis of the adjusting screw on the other hand are thereby perpendicular to each other. In order that the head of the adjusting screw can still be detected and rotated, it is connected to the toothed disk, which comprises a peripherally arranged annular gear with teeth, which are arranged on the upper or lower edge of the toothed disk perpendicular to the tool channel and thus perpendicular to the head of the Phillips screwdriver, which likewise comprises toothing. The toothing on the Phillips screwdriver thus engages in the annular gear of the toothed disk and rotates the latter around the axis of the adjusting screw.

The toothed disk preferably comprises a multi-edge opening, which serves to receive the screw head. By pressing and flattening the screw head a fixed connection between the screw head and the toothed disk can be produced.

A cylindrical spacing element is preferably provided between the flange ring and the screw head or the toothed disk. Said spacing element serves as a stop for the toothed head of the Phillips screwdriver in order to hold it in the correct engagement with the annular gear of the toothed disk. At the same time the toothed disk is held by the spacing element at the height of the screw head.

After the adjustment of the adjusting screw the latter is preferably to be fixed. For this purpose a securing ring is provided in a preferred embodiment within the coupling chamber provided in the carrier profile. Said securing ring comprises at least one holding eyelet projecting into the tool channel and at least one elastically held holding tooth, which engages into the annular gear of the toothed disk. The securing ring is thereby held so that it cannot rotate within the coupling chamber. The holding tooth can be pressed, with a force effect through the tool, on the other hand tooth for tooth to the side, so that the toothed disk can be rotated as needed. Upon discontinuation of the force effect through the tool the tooth engages in the annular gear again and holds the toothed disk and thus the adjusting screw in position without the possibility of rotation.

The adjusting screw can be connected in various ways to the carriage body. In a simple embodiment a threaded bore is provided in the carriage body, in which threaded bore the adjusting screw is rotationally held.

In a particularly preferred embodiment a bearing opening is provided on the other hand in the carriage body, within which bearing opening a carrier bolt is rotationally mounted. The carrier bolt comprises a threaded bore extending perpendicular to the bolt axis. Within said threaded bore the threaded shank of the adjusting screw is rotationally held, said adjusting screw being introduced through an access opening into the bearing opening. The access opening thereby has a larger diameter than the threaded shank of the adjusting screw so that said adjusting screw can be inclined at an acute angle forward and back while the carrier bolt rotates. Through these measures the carrier profile can also be inclined forward and back, so that said carrier profile can be adapted to a corresponding inclination of the separation element, while both running wheels of the carriage lie with the same force against the running rail. An optimal running behaviour is also then guaranteed if the position of the separation element has not been set in an ideal manner.

In a further preferred embodiment the carrier bolt comprises a guide nose on both sides, said guide noses being guided into guide slots of the first and the second side part of the carrier profile.

In a further embodiment the carriage body comprises a coupling element, which can cooperate with a holding buffer element, which serves for the smooth reception of the moving separation element and the holding of the separation element after it has come to a standstill.

In a further preferred embodiment a decoupling prevention mechanism connected to the body of the carriage is provided, said decoupling prevention mechanism securing the coupling of the carriage with the running rail even in case unexpected forces arise. In known systems this securing is achieved through the guide device provided at the lower end of the separation element, as already described. Through this type of securing, however, additional resources are required during the adjustment of the separation element, as an additional factor is to be taken into consideration. In addition a correspondingly designed guide device is needed.

In the inventive decoupling prevention mechanism an elastic holding bracket is provided on the carriage body, which elastic holding bracket downwardly projects over said carriage body and can engage with foot elements around the head element of the associated running rail on both sides and hold it loosely. In order that the elastic holding bracket does not become independently released from the coupling element and from the head of the running rail, a U-profile-shaped fixing frame is pushed over the elastic holding bracket and locked. The elastic holding bracket is thus held in position by the rigid fixing frame, after which the carriage is securely coupled with the running rail.

Through the inventive decoupling prevention mechanism the carriage is thus directly coupled with the running rail, on which it travels. Having regard to this decoupling prevention mechanism autonomously provided on the carriage, any consideration of these problems in the design of the guide device or the adjustment of the separation element is superfluous. Unexpected force effects can no longer lead to derailing of the carriage when using an inventive decoupling prevention mechanism.

The carriage can be connected in various ways to the panel of a separation element. For example a mounting plate is provided on the carrier profile, which mounting plate can be directly screwed to the panel, in particular a wooden panel.

Alternatively the carrier profile can also be connected to a first limb of a, for example L-shaped, mounting profile, of which the second limb is connected to the panel. The upper side of the carrier profile is preferably provided with a detent element, into which the first limb of the mounting profile can engage at an appropriate point. In this way the distance of the panel from the carriage can be selected in stages. Furthermore, running rails and guide rails can be used with a plurality of rail elements, along which a plurality of separation elements can be displaced parallel to each other.

On the lower side of the panel a guide device is preferably mounted in a releasable manner and it comprises an angular body with a vertical wing and a horizontal wing. In this connection a mounting channel is provided on the vertical wing on the angle outer side. A mounting strip secured in a fixed or releasable manner to the panel can be introduced into the mounting channel and be held there in a releasable way preferably by means of a locking element. On the angle inner side the horizontal wing comprises at least one guide roller, which can cooperate with the guide rail or a rolling surface.

In order that the running rail and/or the guide rail can be mounted with minimal space requirements, at least one adapter plate is used according to the invention, which is mounted on the body, e.g. wardrobe, which is to be closed with at least one separation element. In spite of the additional space requirement for the adapter plate this has the advantage that only a minimal space requirement is needed for the assembly of the running rail. The running rail can thereby be guided via a plurality of parts of the body, e.g. via a plurality of parts of a wardrobe, which are constructed sequentially. It is not therefore necessary for a segment of the running rail or guide rail to be provided for each wardrobe part and for these to be precisely mounted and adapted to each other, so that misalignments are avoided at the abutment points. It is merely necessary for an adapter plate to be provided on each wardrobe element and for example to be orientated using a gauge. Discrepancies in the arrangement are automatically compensated in the embodiment of the adapter plate described below.

In this preferred embodiment the running rail and/or the guide rail comprise a rail plate, said rail plates being provided on the upper side with at least one rail element serving for the rolling of the running wheels or guide rollers and on the lower side with at least one mounting bracket extending parallel to the rail element. The mounting bracket provided on the rail plate thereby cooperates with a corresponding counter bracket, which is provided on the adapter plate. At least one mounting strip with at least one threaded bore, in which a counter screw can be held and rotated against the mounting bracket and the counter bracket, is thereby provided on the adapter plate. The mounting bracket is thus pressed so far against the counter bracket until they at least partially lie against each other. Erroneous orientation of the adapter plate, in which the mounting bracket and counter bracket do not lie planar against each other, therefore remains without consequence. Abutment points are completely avoided so that optimal travel properties result over the whole running path, in which preferably a one-piece running rail is placed. In order to fix the running rail even more strongly the counter screws can also be provided on the front side with a cup point.

In preferred applications the separation element is held in a displaceable manner to the fore of the front of the body, in particular a body formed by building parts or a furniture item, on the upper side of which the running rail is provided and on the lower side of which the guide rail is provided. The advantages of the inventive solution are, however, also effective in other applications.

As mentioned, a holding buffer element is preferably used, which serves to receive and hold the separation element. Such holding buffer elements are typically screwed within a, for example U-profile-shaped, rail profile. Insofar as a suitable rail profile is lacking, the holding buffer element must be connected to the wardrobe or masonry. In turn a correspondingly large amount of space is thereby required. The connection with the masonry or parts of a wardrobe is on the other hand undesirable as these high-resource interventions can necessitate subsequent renovation works if changes to the installation are carried out.

According to the invention a holding buffer element is provided, which is bent from a sheet metal element in one piece to form a U-profile, on the lower side of which U-profile flat pressure plates are inclined against each other, which pressure plates are pressed on both sides on preferably flattened sides of the head element of the associated rail element of the running rail and preferably supported on the running rail plate. The side parts of the U profile, which each comprise a receiving element facing the carriage, are pressed by means of at least one mounting screw against each other and thus against the rail element. The flattened sides of the head element and the flat pressure plates can thereby comprise detent elements corresponding to each other, which engage in each other in a shape-locking way. In this way it is ensured that the holding buffer element is held in a stable way. A further result of the inclination of the pressure plates is that they are pressed downwards against the rail plate during mounting of the holding buffer element. It is thus ensured that the holding buffer element cannot deviate downwards or upwards.

The two cooperating receiving elements are preferably connected to each other with a preload screw and formed as plate springs in such a way that the coupling element provided on the body of the carriage can be moved and held therein. The moving-in separation element is thus elastically received and subsequently held securely.

BRIEF DESCRIPTION OF THE DRAWINGS

The invention is described in greater detail below by reference to drawings, in which.

DETAILED DESCRIPTION

Figure 1:
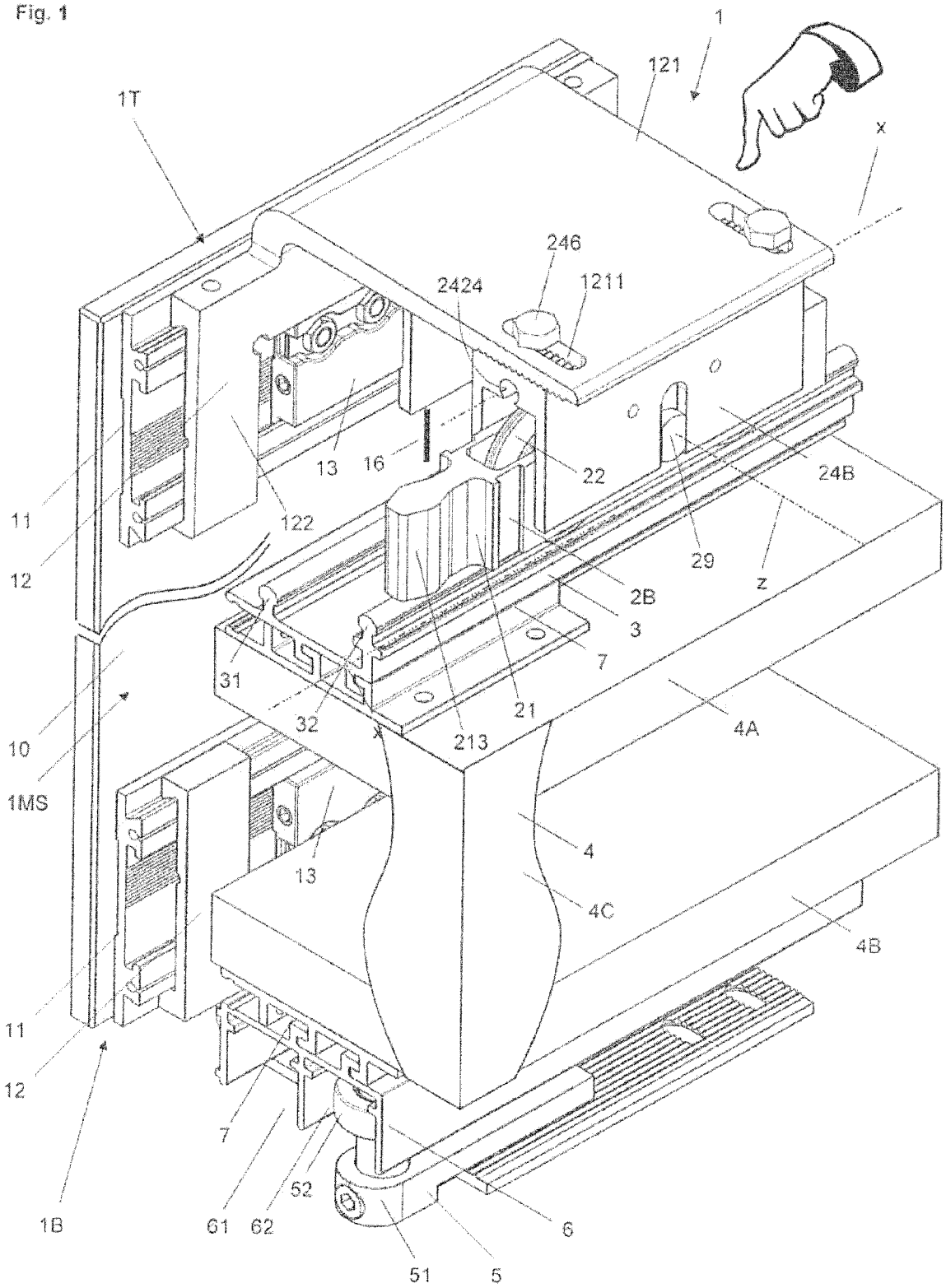
FIG. 1 shows an inventive separation element 1 provided with a glass panel 10, said separation element 1 being held so as to be displaceable by means of an inventive carriage 2 and a guide device 5 in front of a wardrobe, along a running rail 3 mounted thereon and a guide rail 6.

FIG. 1 shows an inventive separation element 1, which comprises a glass panel 10, on the upper side 1T and lower side 1B of which identical installation profiles 11 are mounted in such a way that the front face of the glass panel 10 lies free. The device parts are thus arranged on the mounting side 1 MS of the glass panel 10 lying opposite the front face, said glass panel 10 facing a body to be closed off 4, e.g. a wardrobe. Shown schematically are an upper and a lower wardrobe element 4A/4B and walls 4C of the wardrobe 4. On the upper side of the upper wardrobe element 4A and the lower side of the lower wardrobe element 4B adapter plates 7 are mounted, by means of which a running rail 3 provided with two rail elements 31, 32 and a guide rail 6 provided with two rail elements 61, 62 are held.

On one of the rail elements 32 of the running rail 3 a carriage 2B is guided, which comprises a carriage body 21, which carries running wheels 22 fixed to wheel axles, which carriage body 21 is provided on the front side with a coupling element 213 and which carriage body 21 carries a carrier profile 24B by means of a carrier bolt 29. The carrier profile 24B is connected via a mounting profile 12 to the associated installation profile 11, which is mounted on the upper side of the panel 10. The mounting profile 12 comprises a mounting limb 122 connected to the installation profile 11 and a receiving limb 121 screwed to the carriage 2B.

The guide device 5, which is connected via a further mounting profile 12 to the installation profile 11 fixed to the lower side of the panel 10, comprises a guide wheel 52, which is guided in a rail element or guide channel 62 of the guide rail 6.

Each of the two installation profiles 11 is provided with a holding device 13, between which a rope or cable, preferably a wire cable 16, is tensioned in order to compensate the forces and moments acting on the separation element 1.

FIG. 1 further shows that the carrier profile 24B is preferably completely crossed by a tool channel 2424, the axis x of said tool channel 2424 extending parallel to the running rail 3. As explained in greater detail below, a screwdriver can be introduced into the tool channel 2424 in order to adjust the height of the carrier profile 24B and thus the height and inclination of the panel 10. The carriage 24B is thereby easily accessible from the side, meaning that the adjustments can be carried out rapidly without the separation element 1 or the panel 10 having to be dismantled. Due to the lateral access to the carriage 24B, furthermore, hardly any additional space is necessary for introduction of the tool.

As further clarified, the two running wheels 22 of the carriage 2B lie constantly with the same force on the associated rail element 32 of the running rail 3, while the carrier profile 24B is held by the carrier bolt 29 so as to be rotatable about the axis z. An erroneous adjustment or a negligible inclination of the separation element 1B does not therefore lead to an asymmetrical or double load of one of the running wheels 22, which could thereby fail prematurely.

FIG. 1 further shows that the installation profiles 11 and the mounting limbs 122 of the mounting profiles 12 comprise profile parts corresponding to each other, which can be displaced in each other. The panel 10 can therefore firstly be provided with the installation profiles 11, after which the mounting limbs 12 can be mounted at an appropriate time.

Figures 2, 3:
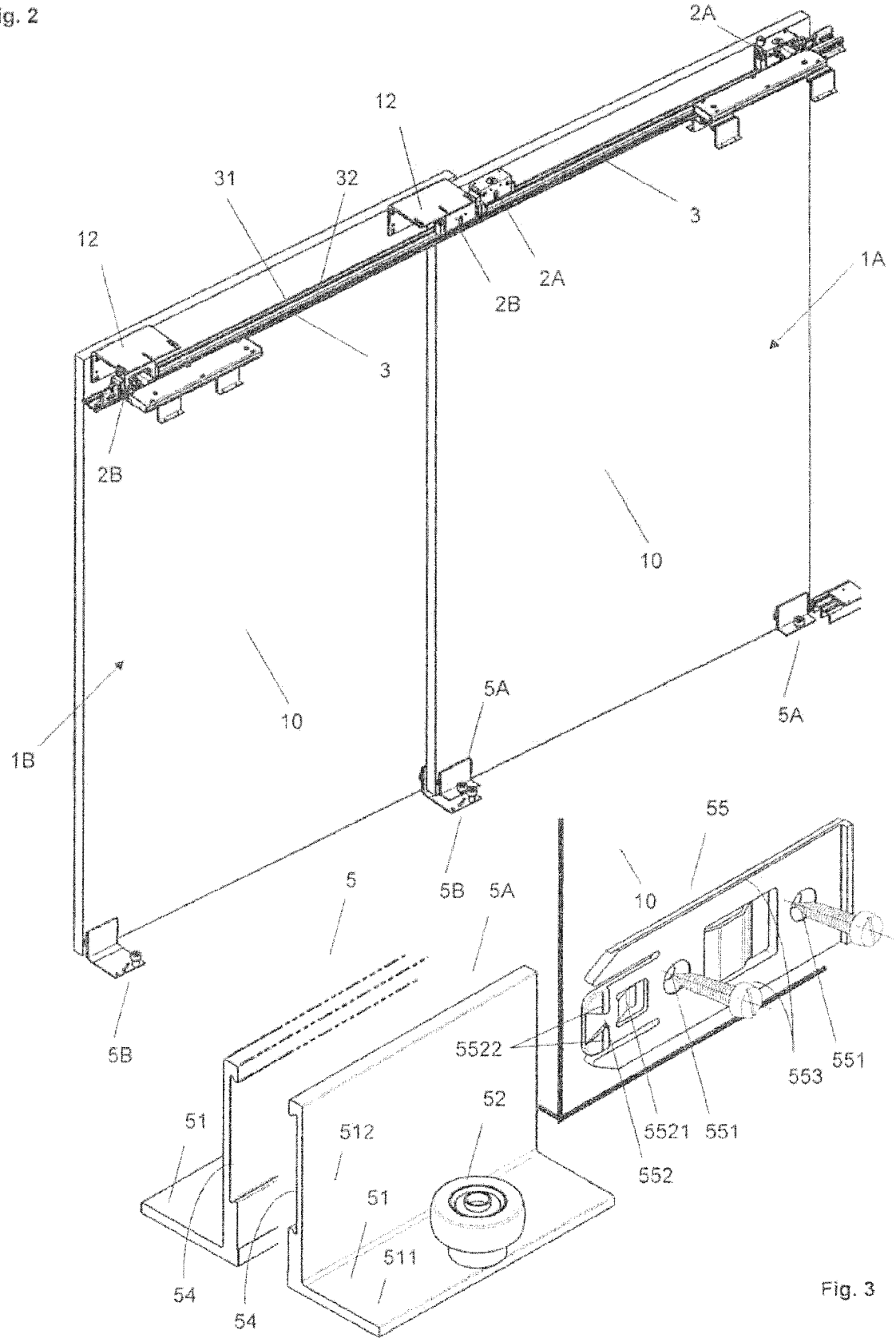
FIG. 2 two separation elements 1A, 1B with carriages 2A, 2B guided by a running rail 3 and inventive guide devices 5, which are assembled in a releasable manner on the lower side of the separation elements 1A, 1B.
FIG. 3 one of the inventive guide devices 5 of FIG. 2 during assembly or dismantling.

FIG. 2 shows two separation elements 1A, 1B, each having two inventive first and second carriages 2A, 2B guided by separate rail elements 31, 32 of a running rail 3. The first carriages 2A are directly screwed to the panel 10 of the first separation element 1A, meaning that no mounting profile 12 is necessary. The second carriages 2B are connected to the panel by means of mounting profiles 12. Insofar as the two separation elements 1A, 1B are displaced against each other the mounting profiles 12 engage over the first carriages 2A. The two separation elements 1A, 1B can thus be pushed past each other as desired. The panels 10, overlapping each other, of the separation elements 1A, 1B are guided in front of the running rail 3, whereby only a limited space is needed above the running rail 3.

FIG. 2 further shows inventive guide devices 5, which are mounted in a releasable manner on the lower side of the separation elements 1A, 1B.

FIG. 3 shows an inventive guide device 5 in case of assembly or dismantling. The guide device 5 comprises an angular body 51 with a vertical wing 512 and a horizontal wing 511. The vertical wing 512 is provided on the angle outer side with a mounting channel 54, into which a mounting strip 55 fixed to the panel 10 can be introduced. The mounting strip 55 comprises openings 551 for receiving mounting screws and a locking element 552 provided with a tongue 5521 and holding ribs 5522. By means of said locking element 552 the mounting strip 55 introduced into the mounting channel 54 is held there. By means of the spring-elastic tongue 5521, which lies against the panel 10, the locking element 552 is pressed against the vertical wing 512, which is overlapped by the holding ribs 5522. In order to release the guide device 5 the locking element 552 must be pressed against the resistance of the tongue 5521 so far against the panel 10 until the holding ribs 5522 are completely released from the vertical wing 512. The guide device 5 can thus be installed and dismantled with a hand grip in order to prevent damage in case the separation element 1A; 1B is released from the running rail 3. The horizontal wing 511 comprises on the angle inner side a guide roller 53, which can be guided within the guide rail 6, as shown in FIG. 1 with a different embodiment of the guide device 5.

First and second guide devices 5A, 5B are thereby provided on the two separation elements 1A, 1B of FIG. 2. Said first and second guide devices 5A, 5B differ in the dimensions of the vertical wing 512 and the horizontal wing 511 in such a way that the horizontal wing 512 of the second guide device 53 lies below the horizontal wing 511 of the first guide device 5A and the guide rollers 52 can engage at a desired mutual distance into the rail elements 61, 62, running parallel to each other, of the guide rail 6 (see FIG. 11).

Figure 4:
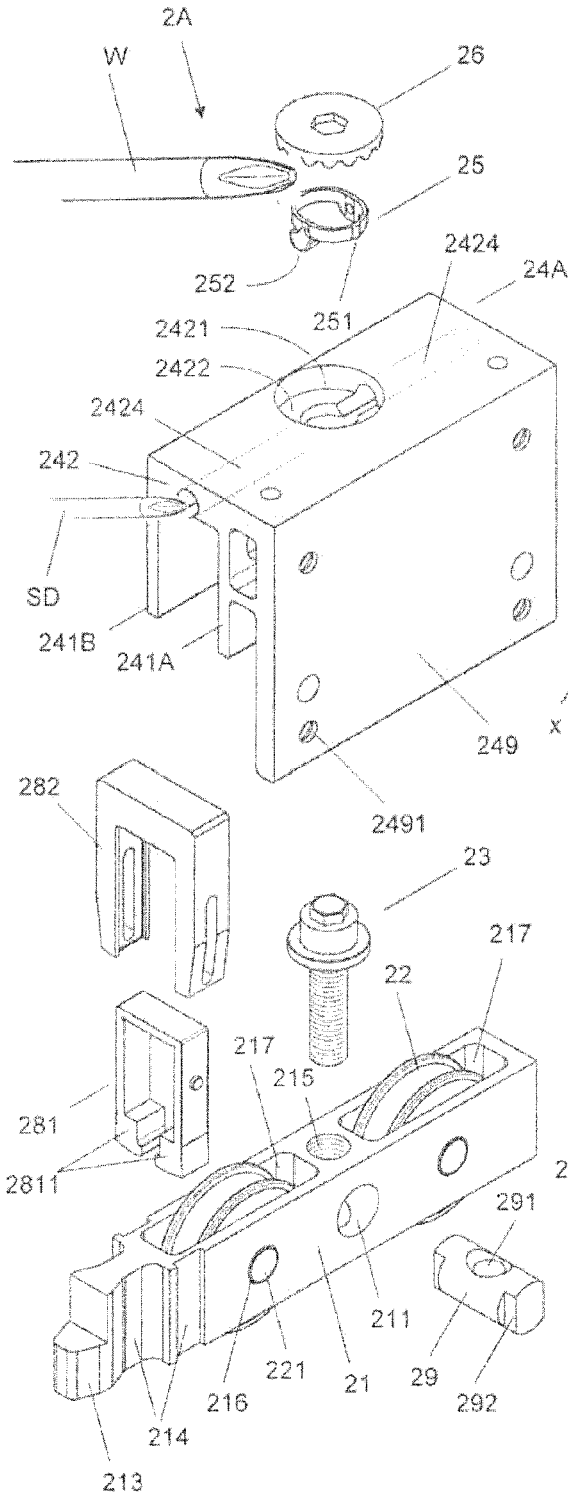
FIG. 4 the first inventive carriage 2A adjustable in height with a decoupling prevention mechanism 28 and with a carrier profile 24A, which is directly connected to the panel 10 of the associated separation element 1A of FIG. 2.

FIG. 4 shows the first inventive carriage 2A, adjustable in height, with a carrier profile 24A, which can be directly connected to the panel 10 of the associated separation element 1A of FIG. 2.

Figure 5:
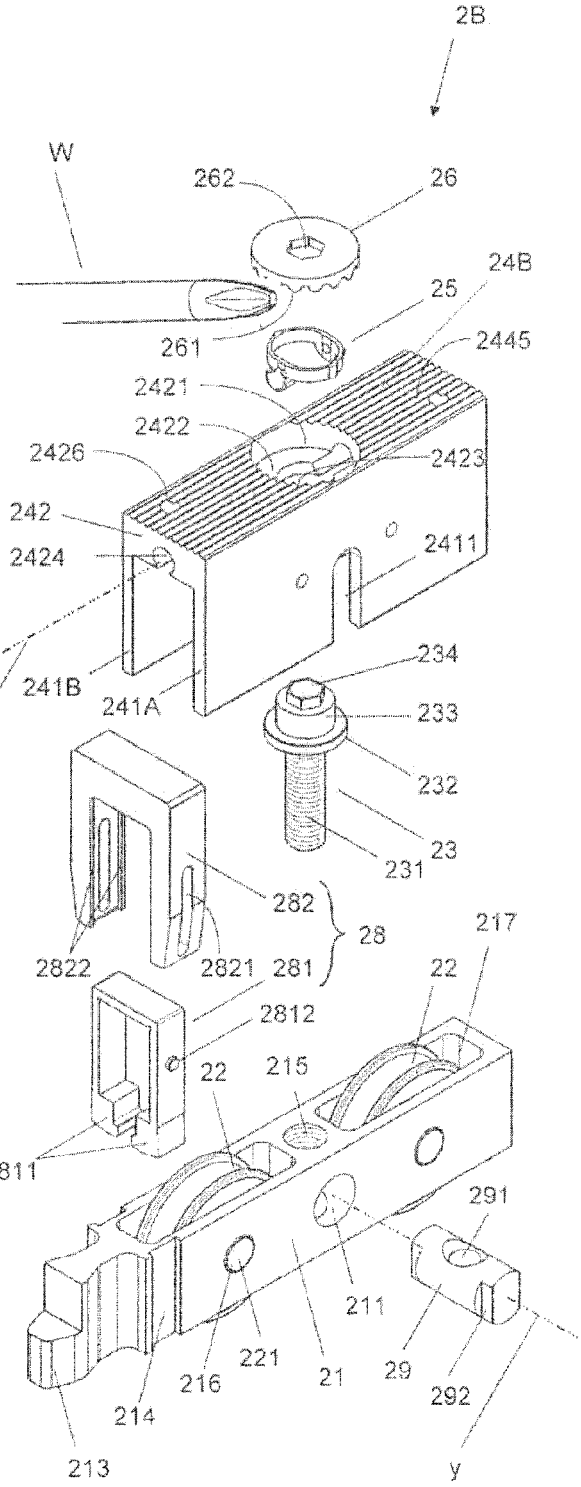
FIG. 5 the height-adjustable second inventive carriage 2B with a decoupling prevention mechanism 28 and with a carrier profile 24B, which is connected by means of a mounting profile 12 to the associated separation element 1B of FIG. 2.

FIG. 5 shows the second inventive carriage 23 of FIG. 1, also adjustable in height, with the carrier profile 24B, which can be connected by means of the mounting profile 12 to the associated separation element 1B of FIG. 2.

The two carriages 2A and 23 differ only through the design of the respective carrier profile 24A and 24B, which is correspondingly adapted for the corresponding mounting on the associated separation element 1A or 1B. The first carrier profile 24A comprises a mounting plate 249, which can be screwed directly to the panel 10 of the first separation element 1A, in which mounting plate 249 bores 2491 are provided for passing through mounting screws 2492 (see also FIG. 12). If appropriate the bores 2491 also run through the carriage body 21 or a part thereof. The second carrier profile 24B comprises on its upper side threaded bores 2426, into which mounting screws 246 (see FIG. 1) serving to hold the mounting profile 12 can be introduced. The second carrier profile 24B is further provided on its upper side with a catch 2445, which allows the receiving limb 2 of the mounting profile 12, provided with mounting slots 1211, to be displaced laterally in stages and to be held in a shape locking way in the desired position.

The further, preferably identical parts of the two carriages 2A and 2B are explained in detail below by reference to FIGS. 4 and 5.

The two carriages 2A and 2B comprise a carriage body 21, which can preferably be produced cost-effectively for example by means of an extrusion process and only requires limited machining after the extrusion and cutting process. The carriage body 21 serving as a chassis or wheel box comprises two wheel chambers 217, in which running wheels 22 are rotationally mounted by means of shafts 221 held in bores 216.

Between the wheel chambers in the carriage body 21 an access opening 215 is provided, which extends perpendicular to the running rail 3 and through which an adjusting screw 23 can be introduced within the carriage body 21 into a bearing opening 211, in which a carrier bolt 29 provided with a threaded bore 291 is rotationally held. The adjusting screw 23 can thus be pivoted about the axis y of the carrier bolt 29, which extends horizontally and perpendicular to the running rail 3, at an acute angle forwards and backwards, said angle being determined by the diameter of the access opening 215.

In a less advantageous, simpler embodiment the access opening 25 is on the other hand a simple threaded bore, within which the adjusting screw can merely be adjusted in height but cannot be laterally deflected.

The adjusting screw 23 comprises, below its screw head 234, a flange ring 232, which supports a flange element 2422 provided in the carrier profile 24A; 24B. Said flange element 2422 comprises an opening 2423, through which the screw head 234 is guided.

Each of the carrier profiles 24A, 24B comprises a U-shaped profile with two side parts 241A, 241B and a middle part 242. In the middle part 242 a coupling chamber 2421 is provided, into which a tool channel 2424 extending parallel to the longitudinal axis x of the middle part 242 runs. Said tool channel 2424 runs through the middle part 242 from one end as far as the coupling chamber 2421, but preferably as far as the other end, as shown in FIG. 4. The head of a Phillips screwdriver W can thus be introduced from both front sides of the carrier profile 24A/24B through the tool channel 2424 into the coupling chamber 2421, within which the screw head 234 is arranged.

After the screw head 234 has been introduced into the coupling chamber 2421 during the assembly of the carriage 2A; 2B, said screw head 234 is connected to a toothed disk 26, which comprises a peripherally arranged annular gear 261, which is orientated on the lower edge of the toothed disk 26 perpendicular to the tool channel 2424. The toothed disk 26 comprises a hexagonal opening 262 serving to receive the screw head 234, said hexagonal opening 262 serving to receive the hexagonal screw head 234. The axial securing of the toothed disk 26 is carried out preferably by pressing and flattening the projection of the screw head 234, after which the toothed disk 26 is held in a shape-locking way and can no longer be released from the screw head 234.

The toothed disk 26 is thus held on the upper side of the flange element 2422 defining the coupling chamber 242 and the flange ring 232 is held on the lower side of the flange element 2422 so that the rotationally held adjusting screw 23 can no longer be released from the carrier profile 24A, 24B.

Between the flange ring 232 and the screw head 234 or the placed-on toothed disk 26 a spacing element 233 is provided, which also projects into the coupling chamber 2421 and serves there as a stop for the toothed head of the Phillips screwdriver W in order to hold it in optimal engagement with the annular gear 261 of the toothed disk 26. The head of the Phillips screwdriver W can thus be introduced through the tool channel 2424 into the coupling chamber 2421 until it lies against the spacing element 233. In this position the required engagement of the teeth of the tool head in the annular gear 261 of the toothed disk 26 takes place simultaneously. In order that the rotation of the adjusting screw 23 can take place particularly easily the spacing element 233 preferably also serves as a bearing shaft, which is mounted within the opening 2423 in the flange element 2422 so as to preferably be practically clearance free.

Figure 8:
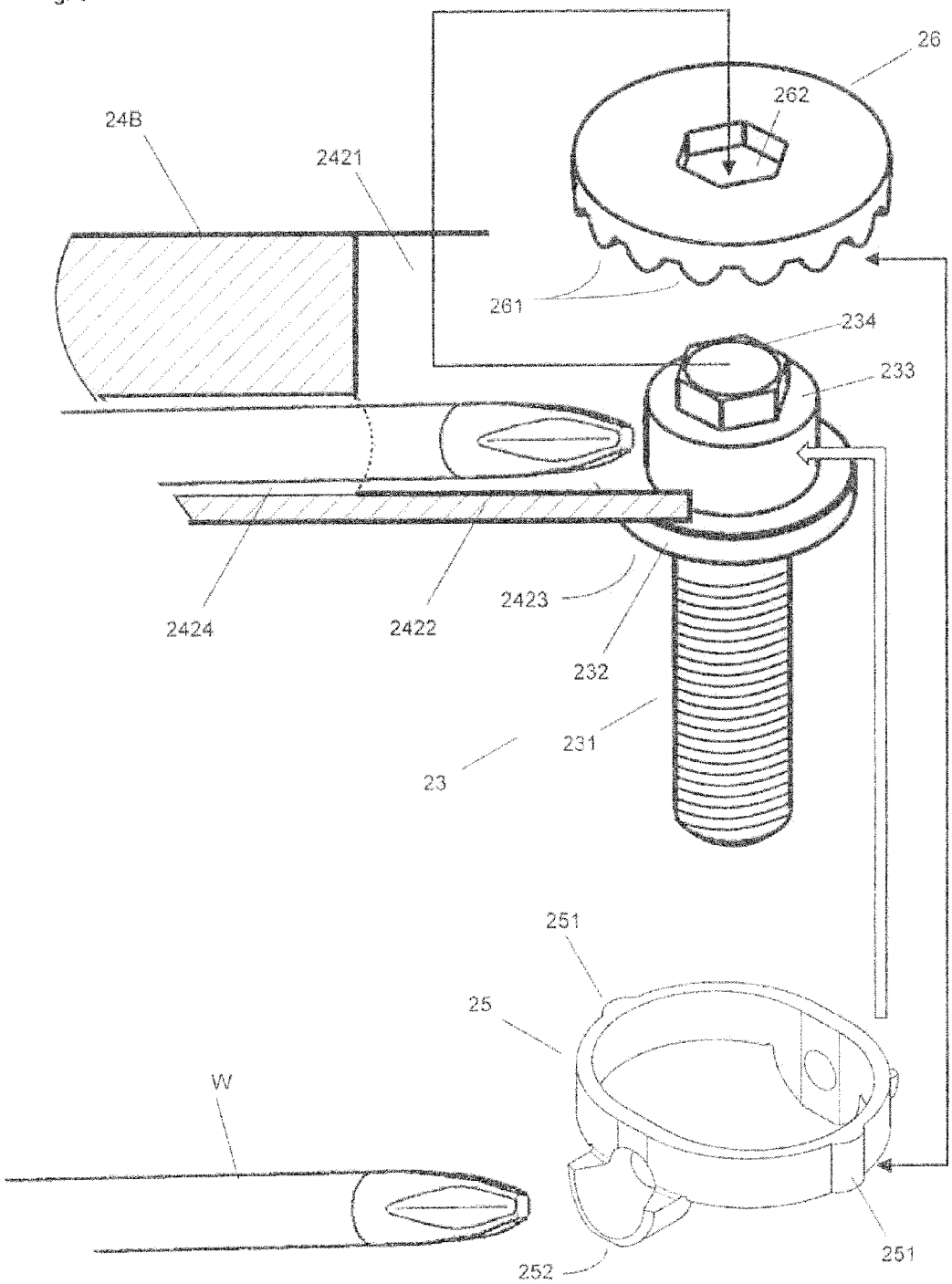
FIG. 8 parts of the adjusting device in the first and second carriage 2A, 2B, namely an adjusting screw 23, of which the screw head 234 is connected to a toothed disk 26, and a securing ring 25, which prevents the independent rotation of the adjusting screw 23.

A securing ring 25 is provided within the coupling chamber 2421 as security against independent rotation of the adjusting screw 23. Said securing ring 25, preferably made of plastic, comprises two holding eyelets 252 projecting into the tool channels 2424 and two elastically held holding teeth 251, which engage in the annular gear 261 of the toothed disk 26, as shown in FIG. 8. The securing ring 25 is thus held between the flange element 2423 and the toothed disk 26 so that it cannot deviate from the coupling chamber 2421. Through the holding eyelets 252, through which the screwdriver W can be guided, the securing ring 25 is additionally secured against rotation. Upon rotation of the screwdriver W the toothed disk is thus rotated, whereby the holding teeth 251 are displaced in stages out of the annular gear 261, but after the removal of the screwdriver W they engage therein again. A once-selected adjustment of the carriage 2A; 2B is thus retained.

Guide slots 2411 are further provided in the side parts 241A, 241B provided on the carrier profiles 24A and 24B. Guide noses 292 are guided and held so that they cannot be rotated in said guide slots 2411, said guide noses 292 being provided on both sides on the carrier bolt 29. The guide noses 292 can move in the guide slots 2411 upwards and downwards and are rotated together with the associated carrier profile 24A; 24B so that the axes of the carrier profile 24A; 24B and the adjusting screw 23 are constantly perpendicular to each other.

Figure 14:
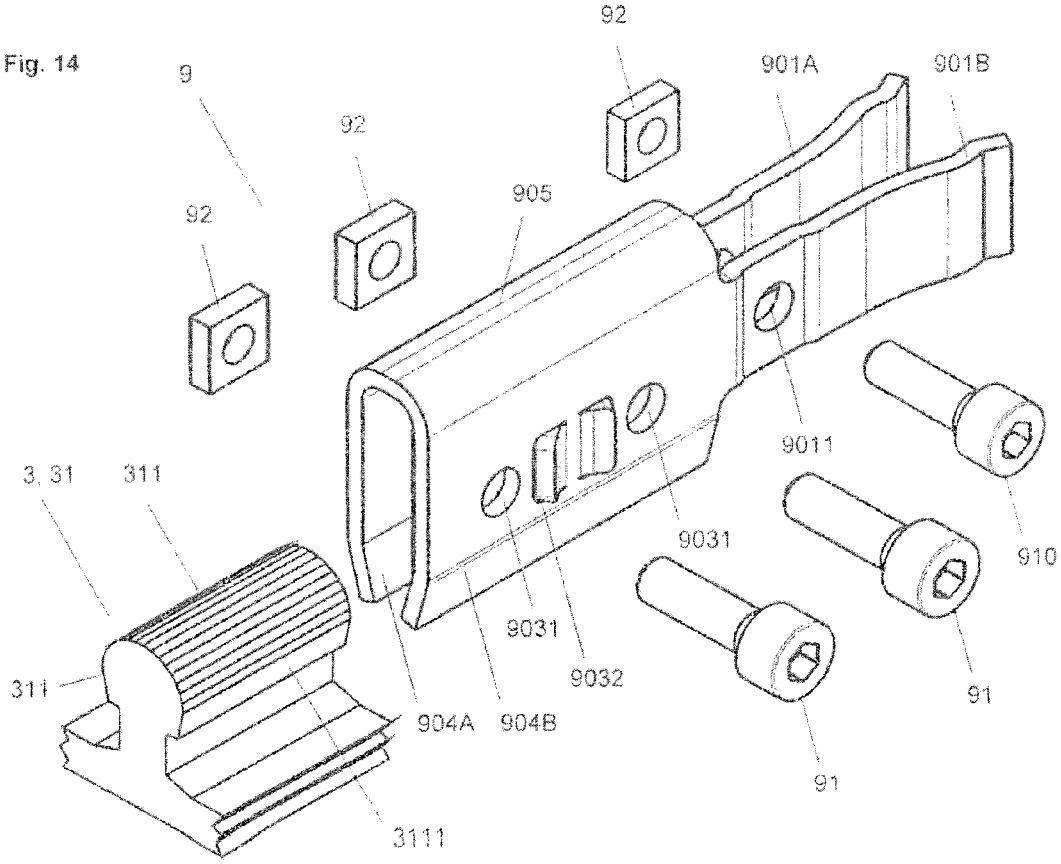
FIG. 14 the finished holding buffer element 9 punched out of the sheet metal and also the appropriately formed head element 311 of the rail element 31, on which the holding buffer element 9 is placed.

The carriage body 21 further comprises on the front side a coupling element 213, which can cooperate with the holding buffer element 6 shown in FIG. 14.

The carriage body 21 further serves to receive a decoupling prevention mechanism 28 and is provided for this purpose with recesses 214 on each side. The decoupling prevention mechanism 28 comprises a U-profile-shaped elastic holding bracket 281, which is placed on the carriage body 21 in the manner of a rider and held in the recesses 214 provided in said carriage body 21. The holding bracket 281 comprises at the lower ends foot elements 2811 orientated against each other, whereby said foot elements 2811 can engage downwardly over the coupling element 213 and can surround the head 311 of the associated rail element 31 of the running rail 3 on both sides. Insofar as the carriage 2A; 2B is raised, however, the unsecured foot elements 2811 are pressed on both sides and the carriage 2A; 2B can be released from the running rail 3. In order to prevent this, a rigid fixing frame 282 with a U-shaped-profile made of metal or plastic is pushed over the holding bracket 281 so that it is held and fixed on both sides.

In order that the fixing frame 282 is not released from the holding bracket 281, said holding bracket 281 comprises connecting cams 2812, which are guided in connecting slots 2821 provided in the side parts of the fixing frame 282. The side parts of the fixing frame 282 are further provided with securing flanges 2822, which overlap the holding bracket 281 to the front and to the rear. The fixing frame 282 is thus connected in a shape locking way to the holding bracket 281 and can only be released from this if it is manually drawn upwards, following which the foot elements 2811 of the holding bracket 281 regain their mobility.

Figure 6:
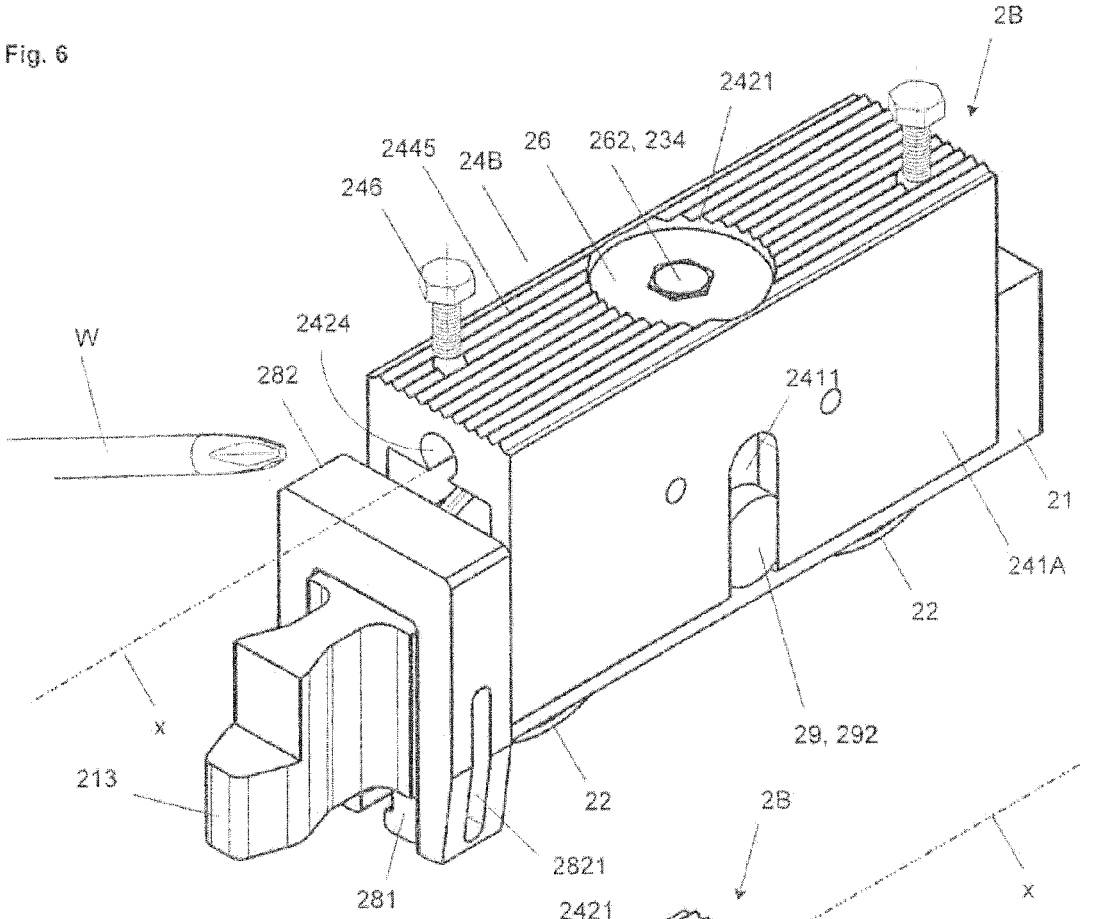
FIG. 6 the carriage 2B of FIG. 4 with upwardly travelled carrier profile 24B.

FIG. 6 shows the carriage 2B of FIG. 4 with upwardly travelled carrier profile 24B.

Figure 7:
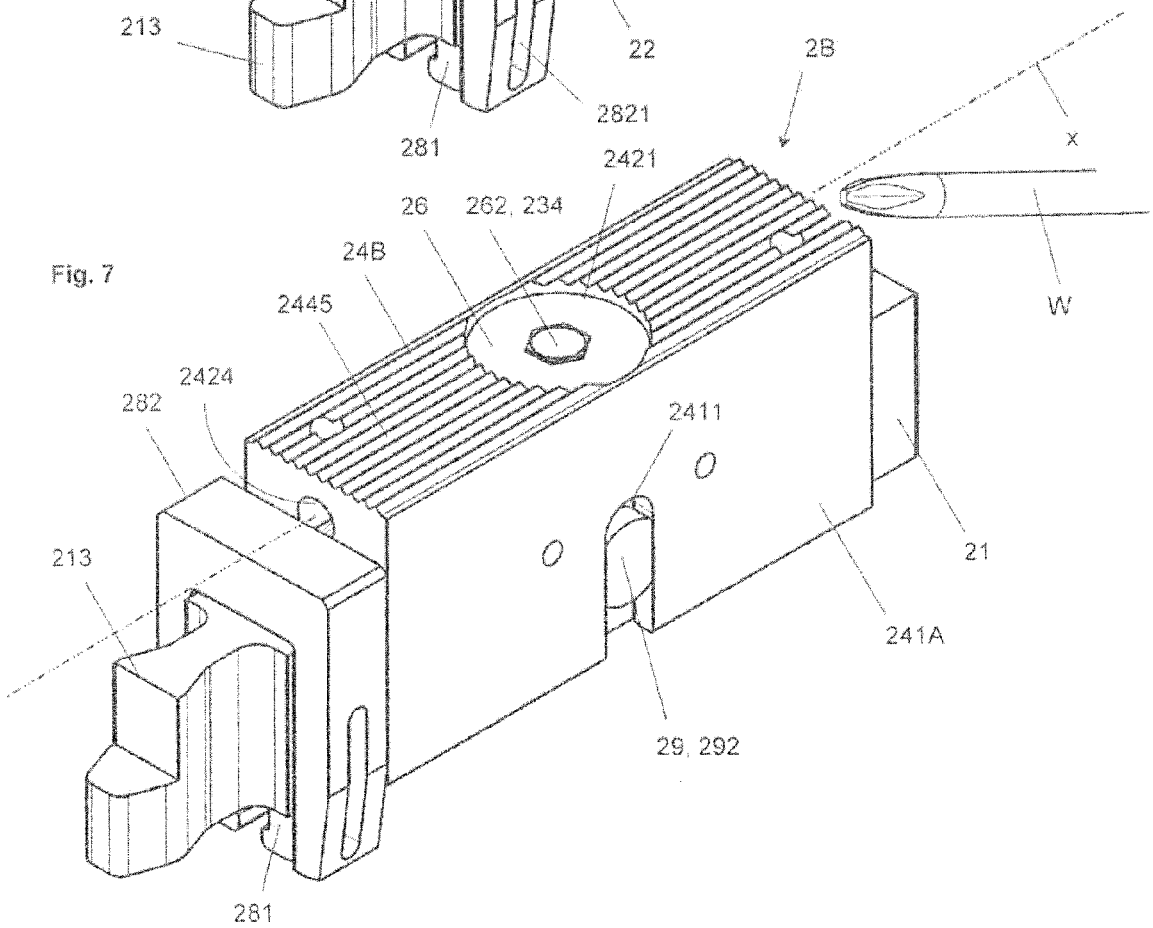
FIG. 7 the carriage 2B of FIG. 4 with downwardly travelled carrier profile 24B.

FIG. 7 shows the carriage 2B of FIG. 4 with downwardly travelled carrier profile 24B.

As illustrated in FIGS. 6 and 7, the head of the screwdriver W can be introduced on both sides through the tool channel 2424 into the coupling chamber 2241 in order to rotate the adjusting screw 23. Subject to the coupling element 213 the carriages 2A, 2B are thus designed symmetrically and can thus be mounted in any orientation on each side of the separation element 1A; 1B. Access by means of the tool W is therefore constantly guaranteed.

FIG. 8 shows the above-described parts of the adjusting device in the first and second carriage 2A, 2B, namely the adjusting screw 23, the toothed disk 26 and the securing ring 25, whereby the latter prevents independent rotation of the adjusting screw 23. It is further shown that the screwdriver W introduced through the tool channel 2424 into the coupling chamber 2421 is held in position through the spacing element 233 provided below the screw head 234. It is further shown schematically that the screwdriver W is introduced through the holding eyelet 252 of the securing ring 25 into the coupling chamber 2421.

Figure 9:
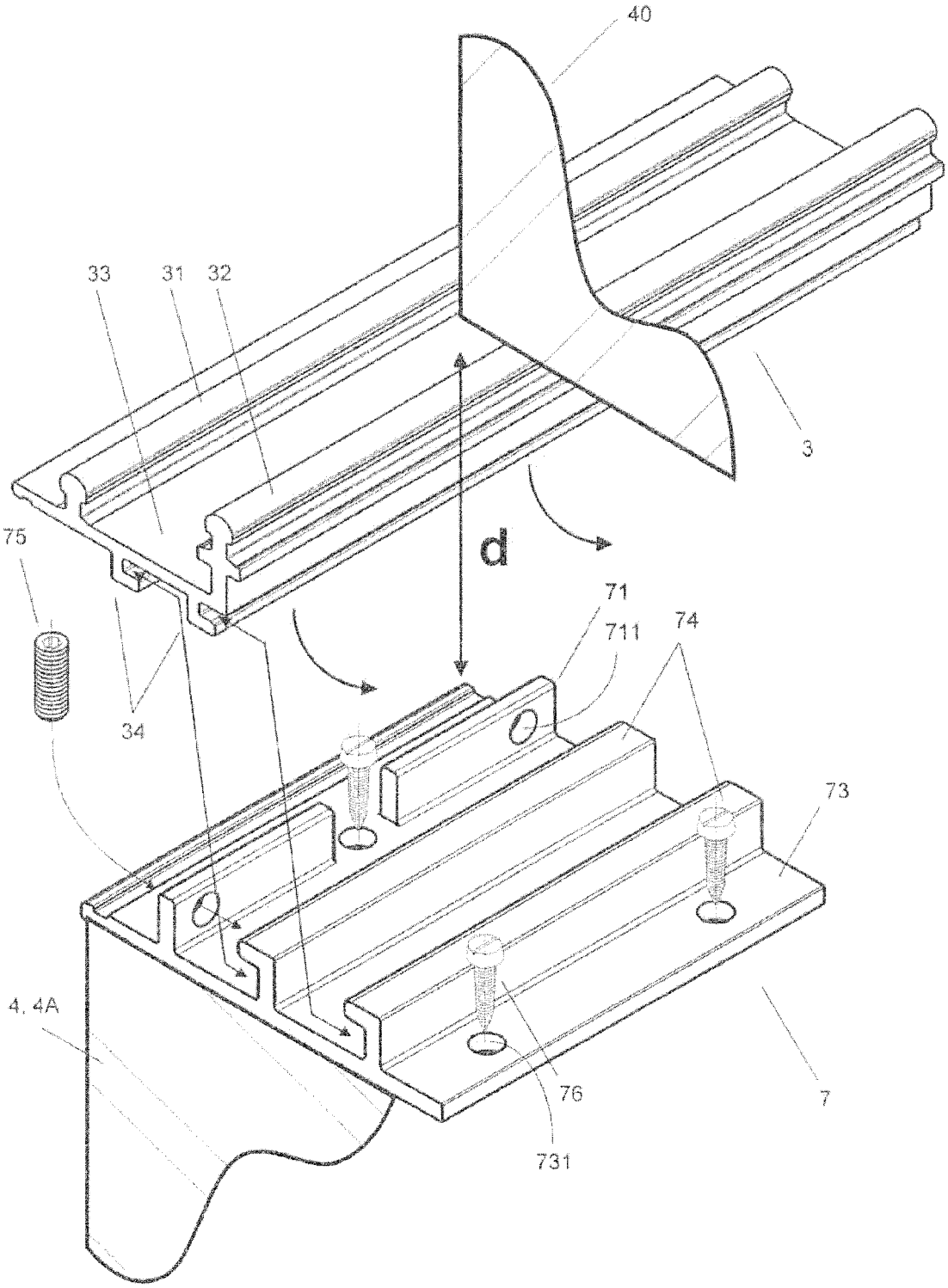
FIG. 9 a running rail 3, which is placed from the front on an adapter plate 7 and fixed by means of a counter screw 75 accessible from the front side.

FIG. 9 shows the running rail 3 and the adapter plate 7 of FIG. 1. The running rail 3 comprises a rail plate 33, on the upper side of which two rail elements 31, 32 serving for the rolling of the running wheels 22 are provided and on the lower side of which two mounting brackets 34 extending parallel to the rail elements 31, 32 are provided. The two mounting brackets 34 correspond to two counter brackets 74, which are provided on the adapter plate 7, which is mounted on the upper side of a wardrobe 4 by means of screws 76, which are guided through openings 731. The running rail 3 can thus be guided from the front or the front side of the wardrobe 4 over the adapter plate 7 and be displaced backwards until the mounting brackets 34 and the counter brackets 74 engage in each other. Consequently counter screws 75, which are held in threaded bores 711 of mounting strips 71 connected to the adapter plate 7, are rotated against the mounting bracket 34. By means of these counter screws 75, which can likewise be actuated from the front side of the wardrobe 4, the mounting brackets 34 of the running rail 3 are fixed and said running rail 3 is thus held stable. The one-part or multi-part wardrobe 4, which can be of any breadth, can thereby be equipped with several adaptable plates 7, which are orientated as precisely as possible.

The inventive installation system has a relatively high tolerance in relation to erroneous positioning. Slight rotations and displacements of individual adapter plates 7 relative to the ideal position are compensated without problems insofar as the mounting brackets 34 and the counter brackets 74 do not have to lie planar against each other and the stable assembly of the running rail 3 is still guaranteed. As the running rail 3 can only be put in place after installation of the wardrobe 4 said running rail 3 is preferably placed as one element over the whole length, meaning that abutment points are avoided. It can further be seen from FIG. 9 that the distance d between the upper edge of the wardrobe 4 and the ceiling 40 is minimal and can be selected only in consideration of the size of the carriages 2A, 2B, as shown in FIG. 10.

Figure 10:
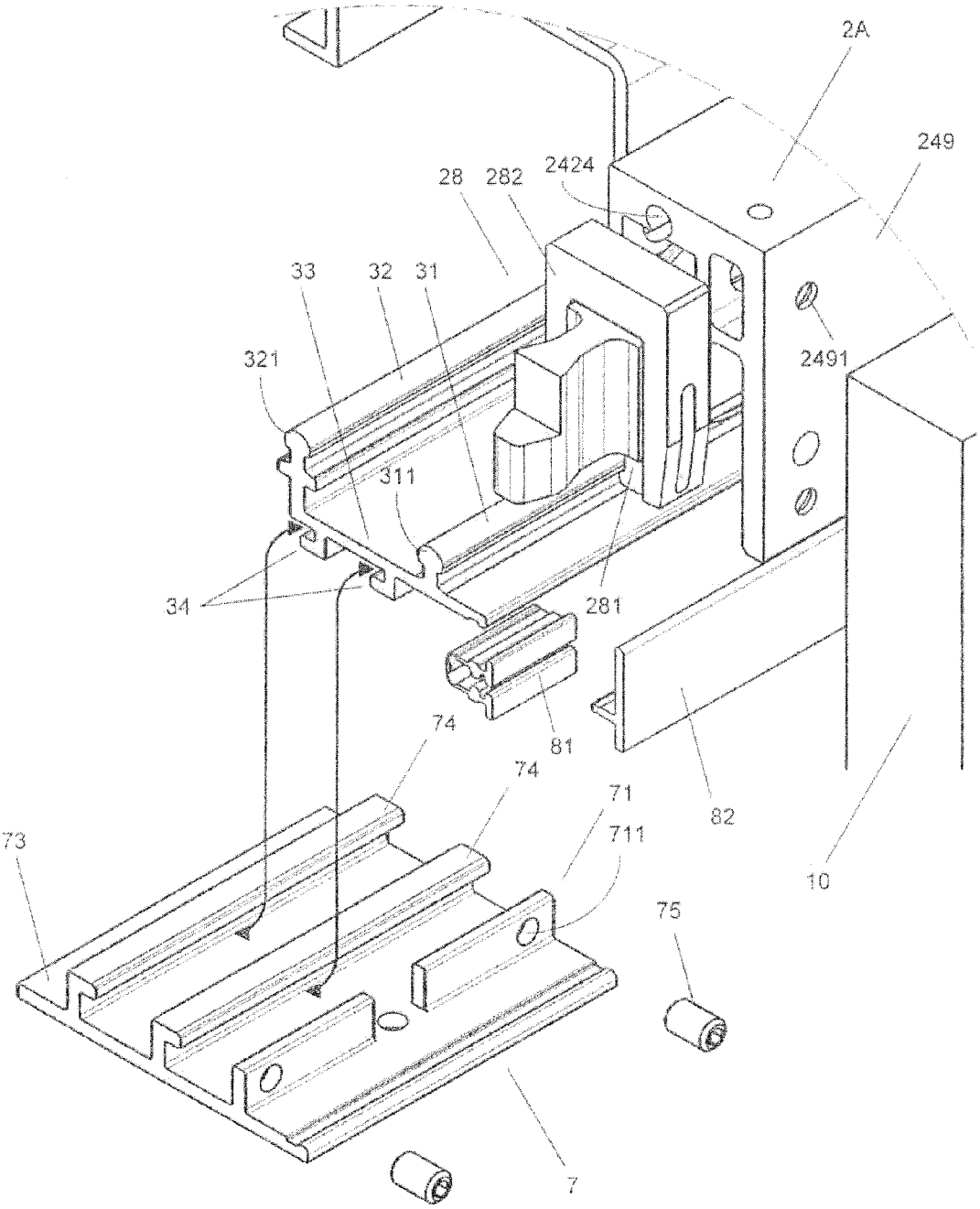
FIG. 10 the first inventive carriage 2A of FIG. 4, the running rail 3, the adapter plate 7 and a clamping profile 81 arranged there-between, said clamping profile 81 serving to hold a cover strip 82.

FIG. 10 shows the carriage 2A of FIG. 4 and also the running rail 3 and the adapter plate 7 of FIG. 9, whereby these are mounted in the aforementioned manner. It is shown that the adapter plate 7 only takes up limited space in relation to the carriage 2A. After mounting of the adapter plate 7 and the running rail 3 a clamping profile 81 is provided therebetween, which serves to hold a cover strip 82. As seen from the front side of the wardrobe 4, the adapter plate 7 and the running rail 3 thus form one unit and do not cause aesthetic interference.

Figure 11:
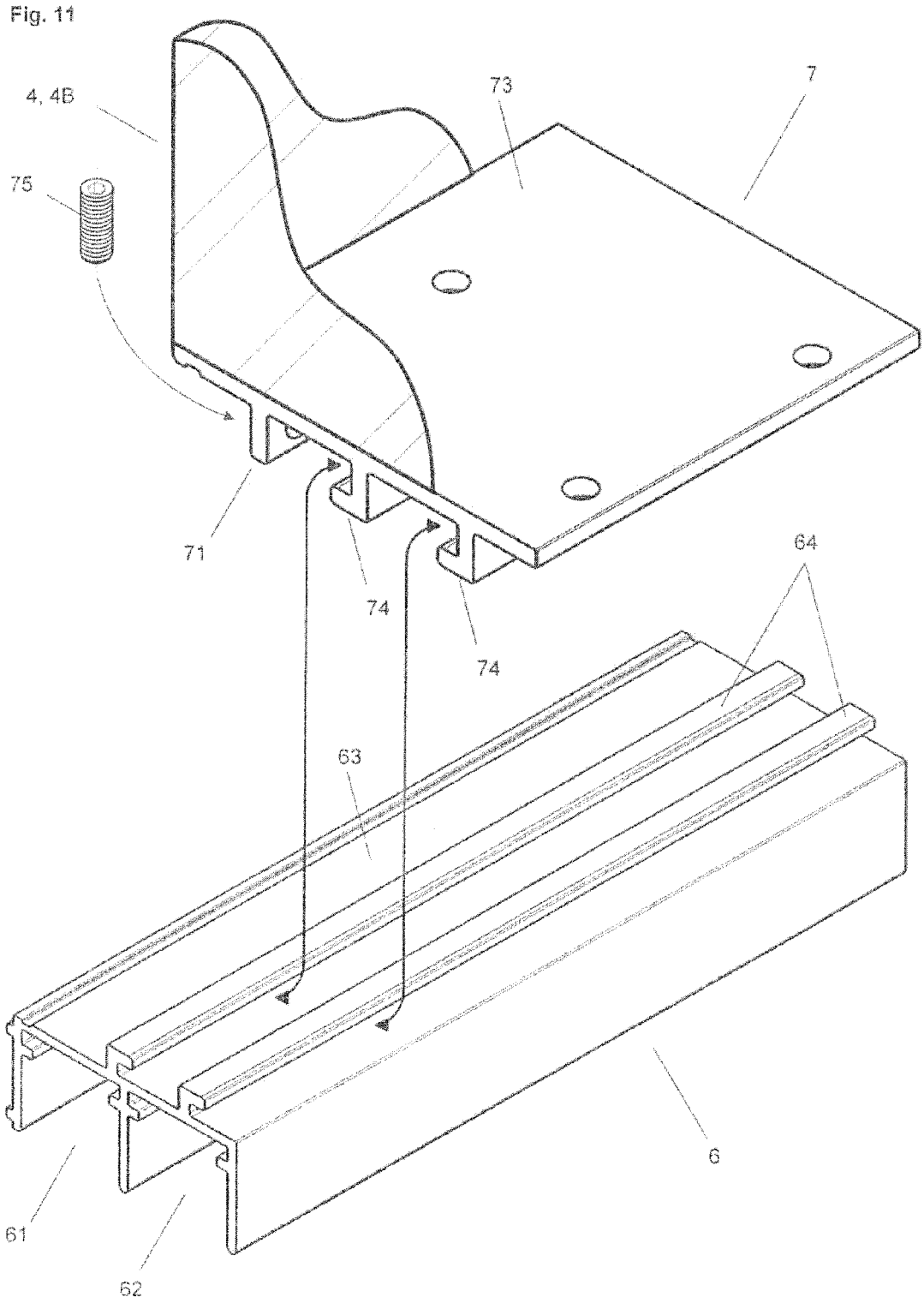
FIG. 11 a guide rail 6, which is placed from the front on an adapter plate 7 and fixed by means of a counter screw 75 accessible from the front side.

FIG. 11 shows a guide rail 6, which is placed from the front on an adapter plate 7 mounted on the lower side of the wardrobe 4 and is fixed by means of a counter screw 75 accessible from the front side. The guide rail 6 comprises a rail plate 63, on the upper side of which two guide channels/rail elements 61, 62 serving for rolling of the guide rollers 52 are provided, and on the lower side of which two mounting brackets 64 extending parallel to the rail elements 61, 62 are provided. The two mounting brackets 64 correspond to two counter brackets 74 provided on the adapter plate. The guide rail 6 can thus be mounted in the same way and with the same advantages as the running rail 3.

Figure 12:
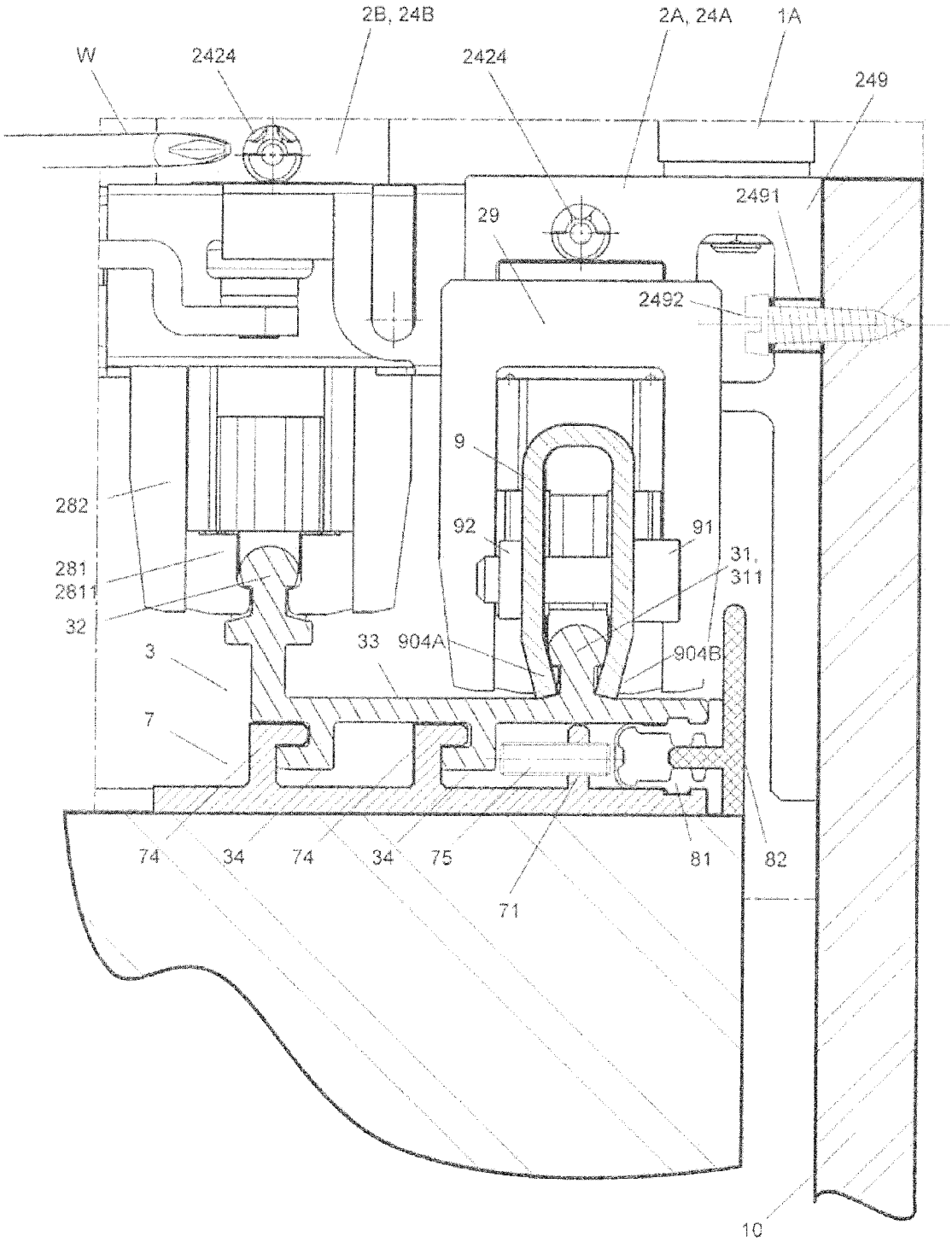
FIG. 12 the carriages 2A, 2B provided with the decoupling prevention mechanism 28, said carriages 2A, 2B being guided on rail elements 31, 32, parallel to each other, of the running rail 3 held by the adapter plate 7, and also an inventive holding buffer element 9 mounted on a rail element 31.

FIG. 12 shows the carriages 2A, 2B provided with the decoupling prevention mechanism 28. Said carriages 2A, 2B are guided on rail elements 31, 32, extending parallel to each other, of the running rail 3 held by the adapter plate 7. It can be clearly seen in the carriage 2B that the foot elements 2811 of the holding bracket 281 held by the fixing frame 282 engage around the head element of the associated rail element 32, so that the carriage 2B cannot be released from the running rail 3. It is further shown that the running rail 3 is pressed by means of a counter screw 75 against the adapter plate 7 so that the mounting brackets 34 and the counter brackets 74 are held displaced in each other. Between the adapter plate 7 and the running rail 3 the clamping profile 81 is held, which for its part holds the cover strip 82. It is further shown that the mounting plate 249 of the carriage 2A is screwed to the wooden panel 10 of the separation element 1A. The mounting screw 2492 provided for this purpose is preferably passed through the whole carrier profile 24B. Furthermore the tool channels 2424 provided in the carrier profiles 24A, 24B of the carriages 2A, 2B are shown, into which the Phillips screwdriver W can be introduced in order to adjust the height of the carrier profiles 24A, 24B.

FIG. 12 further shows a holding buffer element 9 placed on the rail element 31. Said holding buffer element 9 comprises a U-shaped profile, of which the side elements are pressed together by means of a mounting screw 91 and a nut 92 in such a way that the two end elements of the U-shaped profile, which form pressure plates 904A, 904B, are pressed against the head 311 of the associated rail element 31. The holding buffer element 9 is thus directly connected to the rail element 31 and thus requires only minimal space.

Figure 13:
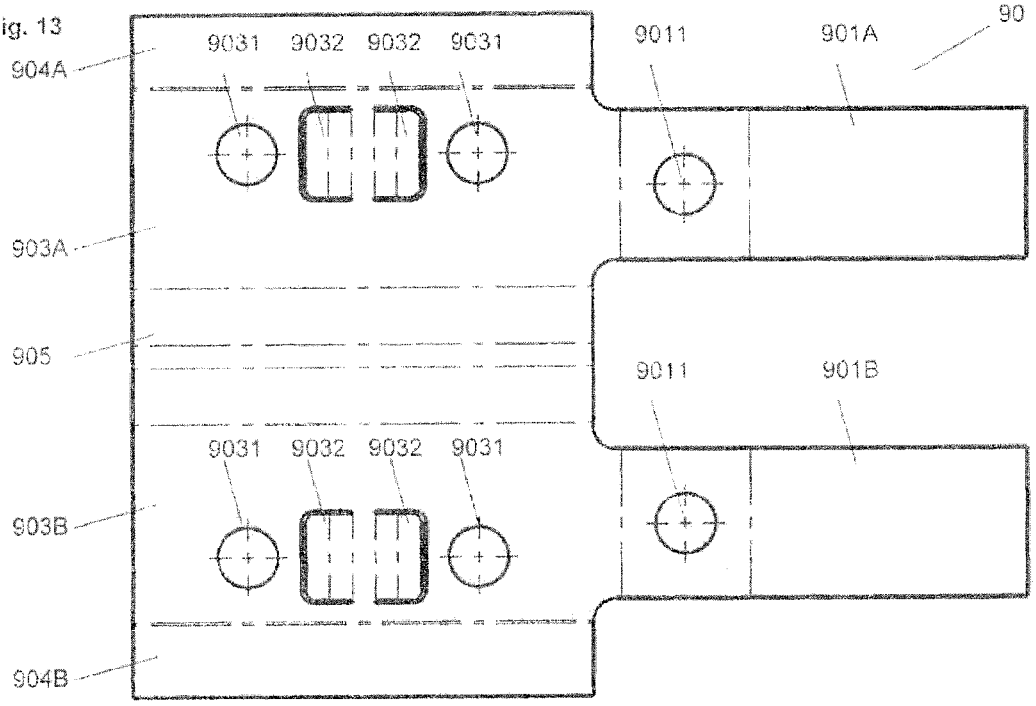
FIG. 13 a development drawing of the one-piece holding buffer element 9 of FIG. 12 punched out of sheet metal.

FIG. 13 shows a development drawing 90 of the one-piece holding buffer element 9 of FIG. 12, which has been punched out of sheet metal.

FIG. 14 shows the holding buffer element 9 punched out of the sheet metal and finished and also the appropriately formed head element 311 of the rail element 31, which comprises on both sides flattened zones 3111, against which the pressure plates 904A, 904B lie planar (see FIG. 12).

As shown in FIG. 14, the holding buffer element 9 is formed to a U-shaped profile. The development drawing thus comprises different zones, which are bent against each other after being punched out of sheet metal. The zones 903A and 903B relate to the side parts of the U-shaped profile, which are provided with bores 9031 for guiding through mounting screws 91 and with unilaterally cut out and bent counter elements 9032, which serve to hold nuts 92. The zone 905 relates to the middle part of the U-shaped profile or the buffer element back. The zones 904A and 904B connecting to the side parts 903A and 903B relate to the above-mentioned pressure plates. The zones 901A and 901B relate to the receiving elements serving to receive the carriage 2A, 2B. Provided in said receiving elements are bores 9011, through which a preload screw 910 can be passed, by means of which the two receiving elements 901A, 901B can be pressed and pre-tensioned against each other.

FIG. 14 shows the holding buffer element 9, which has been formed through bending the individual zones 901A, 901B, 903A, 903B; 904A, 904B and 905 and provided with said bores 9011, 9031 and punched-out elements 9032. The punched-out sheet metal element has been bent to form a one-piece U-shaped profile, on the lower side of which the flat pressure plates 904A, 904B are inclined against each other. After assembly said pressure plates 904A, 904B are pressed on both sides on the flattened sides 3111 of the head element 311 of the associated rail element 31 of the running rail 3 and preferably supported on the running rail plate 3. The side parts 903A, 903B of the U-shaped profile, which each comprise a tongue-shaped receiving element 901A, 90B facing the carriage 2A, 28, are pressed by means of two mounting screws 91 against each other and thus against the rail element 31. As a result the pressure plates 904A, 904B lie, after mounting, stable on the flattened sides 3111 of the head element 31. Furthermore, a result of the inclination of the pressure plates 904A, 904B is that the latter are pressed downwards, during mounting of the holding buffer element 9, against the rail plate 3. It is thereby ensured that the holding buffer element 9 cannot deviate downwards or upwards.

The two cooperating receiving elements 901A, 901B, which are connected to each other with the preload screw 910, are formed as plate springs in such a way that the coupling element 213 provided on the body 21 of the carriage 2A; 2B can move and be held therein. The separation element 1A, 1B is thus elastically received and subsequently held.

LITERATURE

[1] EP 1916372 A1

[2] Product catalogue of HAWA AG, Sliding Fittings 2000

LIST OF REFERENCE NUMERALS

1 Separation element
10 Panel, in particular a glass or wooden panel
11 Installation profile
12 L-shaped mounting profile
121 Receiving limb of the mounting profile 12
1211 Mounting slot for receiving the mounting screw 246
122 Mounting limb of the mounting profile 12
13 Holding device
16 Connection element, cable
2 Carriage
2A First carriage, directly screwed to the panel 10
2B Second carriage, connected via the mounting profile 12
21 Carriage body, body of the carriage 2
211 Bearing opening for the carrier bolt 29
213 Coupling element, corresponding to buffer element 9
214 Recess for receiving the decoupling prevention mechanism 28
215 Access opening, possibly threaded bore
216 Bore in the carriage body 21 for the wheel axles 221
217 Wheel chamber
22 Running wheel of the carriage 2
221 Shaft, wheel axle
23 Adjusting screw
231 Threaded shank of the adjusting screw 23
232 Flange ring on the adjusting screw 23
233 Spacing cylinder on the adjusting screw 23
234 Head of the adjusting screw 23
24A Carrier profile of the first carriage 2A
24B Carrier profile of the second carriage 2B
241A/B Side parts of the carrier profile 24A/24B
2411 Guide slot in the side part 24A/24B
242 Middle part of the carrier profile 24A/24B
2421 Coupling chamber in the middle part 242
2422 Flange element with opening 2423
2423 Opening in the flange element 2422
2424 Tool channel in the middle part 242
2425 catch on the upper side of the middle part 242
2426 Threaded bore in the middle part 242
246 Mounting screws
249 Mounting plate on the carrier profile 24A
2492 Mounting screw, possibly running through the carrier profile
25 Securing ring
251 Holding tooth on the securing ring 25
252 Holding eyelet
26 Toothed disk
261 Annular gear on the toothed disk 26
262 Multi-side opening for receiving the screw head 234
28 Decoupling prevention mechanism
281 Holding bracket
2811 Foot elements on the holding bracket 281
2812 Connecting cams on the holding bracket 281
282 Fixing frame
2821 Connecting slot on the fixing frame 282
2822 Securing flange on the fixing frame 282
29 Carrier bolt
291 Threaded bore for receiving the adjusting screw 23
292 Guide nose (s) on the carrier bolt 29
3 Running rail
31 First rail element of the running rail 3
311 Head element of the first rail element 31
3111 Flat sides of the head element 311
32 Second rail element of the running rail 3
321 Head element of the second rail element 32
33 Running rail plate
34 Mounting bracket on the rail plate 33
4 Body, building or furniture body, wardrobe
40 Ceiling, building body above the wardrobe 4
4A Upper element of the body 4
4B Lower element of the body 4
4C Wall of the installation body 4

5 Guide device
51 Body of the guide device 5
511 Horizontal wing of the guide device 5
512 Vertical wing of the guide device 5
52 Guide roller on the horizontal wing 511
54 Mounting channel in the vertical wing 512
55 Mounting strip
551 Bores for receiving mounting screws
552 Locking element, clip
5521 Tongue
5522 Holding ribs
553 Holding flange
6 Guide rail
61 Rail element/first guide channel
52 Rail element/second guide channel
63 Guide rail plate
64 Mounting bracket on the guide rail plate 63
7 Adapter plate
71 Mounting strip
711 Threaded bore in the mounting strip 71
73 Openings in the adapter plate 7
74 Counter bracket
75 Counter screw
76 Mounting screws
81 Clamping profile
82 Cover strip
9 Holding buffer element
90 Buffer element body, bent
90 Development drawing of the buffer element body 90
901A/B Receiving elements
9011 Bores in the receiving elements 901A/901B
903A/B Buffer element sides
9031 Bores for passing through the mounting screws 91
9032 Counter elements for holding the nuts 92
904A/B Pressure plates
905 Buffer element back
91 Mounting screws
910 Preload screw
92 Nuts

The invention claimed is:

1. Carriage for a displaceable separation element with a carriage body provided with at least two running wheels, said carriage body being connected to a carrier profile, which serves to carry the separation element, wherein a threaded shank of an adjusting screw is rotationally held in the carriage body, said adjusting screw including below the screw head a flange ring, which supports a flange element provided in the carrier profile, said flange element including an opening, through which the screw head is guided, and wherein the carrier profile is a U-shaped profile with two side parts and a middle part, in which a coupling chamber is provided, within which the screw head connected to a toothed disk is arranged, and into which coupling chamber a tool channel extending parallel to the longitudinal axis of the middle part runs, wherein the tool channel runs through the middle part from one end of the middle part to as far as either the coupling chamber or the other end of the middle part.

2. Carriage according to claim 1, wherein the toothed disk includes a multi-edge opening serving to receive the screw head and a peripherally arranged annular gear, which is orientated perpendicular to the tool channel on the upper or lower edge of the toothed disk.

3. Carriage according to claim 2, wherein a securing ring is provided within the coupling chamber provided in the middle part, said securing ring including at least one holding eyelet projecting into the tool channel and at least one elastically held holding tooth, which engages in the annular gear of the toothed disk.

4. Carriage according to claim 1, wherein between the flange ring and the screw head or the toothed disk a cylindrical spacing element is provided, which serves as a stop for the toothed head of a tool in order to hold said toothed head in engagement with the toothed disk.

5. Carriage according to claim 1, wherein a) a bearing opening is provided in the carriage body, within which bearing opening a carrier bolt is rotationally mounted, which includes a threaded bore extending perpendicular to the bolt axis, within which threaded bore the threaded shank of the adjusting screw is rotationally mounted, said adjusting screw being introduced through a broader access opening into the bearing opening or b) the access opening includes a thread, which serves to hold the threaded shank.

6. Carriage according to claim 5, wherein the carrier bolt is provided on both sides with a guide nose, said guide noses being guided in guide slots of a first side part and a second side part of the carrier profile.

7. Carriage according to claim 1, wherein a) the carriage body includes a coupling element, which cooperates with a holding buffer element and/or b) the carriage body serves to hold a decoupling prevention mechanism, which includes a rigid fixing frame, which fixes a U-profile-shaped elastic holding bracket on the carriage body, of which foot elements orientated against each other project downwardly over the carriage body and thereby engage and loosely hold a head element of a running rail on both sides.

8. Carriage according to claim 1, wherein the carrier profile is provided with a mounting plate, which is connected to the separation element, or in that the carrier profile, on the upper side of which a catch is provided, is screwed to a mounting profile.

9. Carriage according to claim 8, wherein the displaceable separation element has a glass or wood panel, and is connected on its upper side to the mounting plate or to the mounting profile.

10. Carriage according to claim 9, wherein a guide device mounted on the lower side of the panel includes an angular body with a vertical wing and a horizontal wing, the vertical wing includes on the angle outer side a mounting channel, in which a mounting strip secured in a fixed or releasable manner to the panel is held in a releasable manner by means of a locking element, and in that the horizontal wing includes on the angle inner side a guide roller.

11. Carriage according to claim 9, wherein the carriage is guided in a running rail and/or a guide device is guided in a guide rail, which are provided on the upper side of a rail plate with at least one rail element serving for the rolling of the running wheels or guide rollers and on the lower side of the rail plate with at least one mounting bracket extending parallel to the rail element, said mounting bracket cooperating with a corresponding counter bracket of an adapter plate mounted at the installation location and being fixed by at least one counter screw, which is rotationally held in a threaded bore of a mounting strip of the adapter plate.

12. Carriage according to claim 11, wherein the separation element is held in a displaceable manner to the fore of the front of a body, the body formed by building parts or a furniture item, on the upper side of which the running rail is provided and on the lower side of which the guide rail is provided.

13. Carriage according to claim 9, wherein a holding buffer element is provided, which is bent from sheet metal in one piece to form a U-shaped profile, on the lower side of which flat pressure plates are inclined against each other, which lie on both sides on flattened sides of a head element of an associated rail element of a running rail and are supported on a running rail plate, wherein the side parts of the U-shaped profile, which each include a receiving element facing the carriage, are pressed by at least one mounting screw against a rail element.

14. Carriage according to claim 13, wherein the two cooperating receiving elements are connected to each other with a preload screw and are formed as plate springs in such a way that a coupling element provided on the body of the carriage moves and is held there.

* * * * *